United States Patent [19]

Shibata et al.

[11] Patent Number: 4,814,815

[45] Date of Patent: Mar. 21, 1989

[54] IMAGE GENERATING DEVICE HAVING A REFLECTING PLATE FOR ELIMINATING CHARGE ON A PORTION OF THE PHOTORECEPTOR OF AN ELECTROPHOTOGRAPHIC COPYING MACHINE

[75] Inventors: Kiyoshi Shibata, Osaka; Kikunosuke Tsuji, Sakai, both of Japan

[73] Assignee: Mita Industrial Co., Ltd., Osaka, Japan

[21] Appl. No.: 18,302

[22] Filed: Feb. 24, 1987

[30] Foreign Application Priority Data

Feb. 28, 1986 [JP] Japan ..... 61-45085

[51] Int. Cl.[4] ..... G03G 15/00

[52] U.S. Cl. ..... 355/3 R; 355/7; 355/8

[58] Field of Search ..... 355/3 R, 8, 11, 71, 355/75, 7, 14 R

[56] References Cited

U.S. PATENT DOCUMENTS

| | | | |
|---|---|---|---|
| 3,671,121 | 6/1972 | Albert | 355/7 |
| 3,912,387 | 10/1975 | Brooke | 355/3 R |
| 4,183,656 | 1/1980 | Ishihara et al. | 355/8 |
| 4,320,959 | 3/1982 | Morikawa et al. | 355/11 |
| 4,334,763 | 6/1982 | Honda et al. | 355/3 R X |

FOREIGN PATENT DOCUMENTS

| | | | |
|---|---|---|---|
| 0049146 | 4/1982 | European Pat. Off. | 355/11 |
| 57-10160 | 1/1982 | Japan . | |
| 58-184965 | 10/1983 | Japan | 355/75 |

OTHER PUBLICATIONS

Gundlach, Robert W., Wells, John B., Vock, Richard C., "Reflex Exposure Light Guide", Xerox Discl. Journal, vol. 1, No. 4, Apr. 1976, p. 83.

*Primary Examiner*—A. C. Prescott
*Assistant Examiner*—Jane Lau
*Attorney, Agent, or Firm*—Antonelli, Terry & Wands

[57] ABSTRACT

An image-generating device for an electrophotographic copying machine; is provided with a white-color reflection plate at a specific position on a component part supporting the light source that is used for illuminating the original document in order to prevent charge from being generated at the position where the separation belt comes into contact with the photoreceptor, while the device sufficiently cancels charge by effectively applying a tapered tip part of the white-color reflection plate without causing a black streak to be generated.

1 Claim, 4 Drawing Sheets

IMAGE GENERATING DEVICE HAVING A REFLECTING PLATE FOR ELIMINATING CHARGE ON A PORTION OF THE PHOTORECEPTOR OF AN ELECTROPHOTOGRAPHIC COPYING MACHINE

BACKGROUND OF THE INVENTION

The present invention relates to an image generating device, more particularly, to an image generating device for an electrophotographic copying machine wherein a separation belt peels the toner image transferred copying paper from the photoreceptor.

Any conventional image generating device which generates a toner image on a copying paper needs to reliably peel the toner-image-received copying paper from the photoreceptor. To achieve this, a prior art device provides means for peeling the toner-image-received copying paper in the form of a separation charger, while another prior art device provides means for peeling the toner-image-received copying paper from the photoreceptor in the form of a separation belt.

In particular, the latter device provides means for preventing a toner image from being generated at the position where the separation belt comes into contact with the photoreceptor by directing light reflected from a white-color reflection plate onto the edge of the surface of the photoreceptor. When operating the system mentioned above, since the portion of the original document obscured from illuminating light by the white-color reflection plate is imaged on the surface of the photoreceptor, this portion eventually causes the appearance of black streaks.

To solve this problem, one of the prior art devices provides means for allowing some of the illuminating light from the light source to be radiated onto the original document, despite the presence of the reflection plate, to cause the majority of the illuminating light to be reflected by the reflection plate. More particularly, Japanese Laid-Open Patent Application No. 10160/1982 discloses, in its FIG. 9, a system having a small hole at a specific position in the reflection plate for allowing illuminating light to pass through this hole. This prior art device also discloses provision of a reflection plate composed of a material allowing a specific amount of illuminating light to pass through it. In addition, this prior art device provides an arrangement with specific angles related to the installation of the mirror-surface reflection plate and edge cutoff angle within the surface which is perpendicular to the original document, and in addition, it includes a pair of luminous bodies. Details of these are shown in FIGS. 11 through 14 of Japanese Laid-Open Patent Application No. 10160/1982.

Of these image-generating devices described above, the device allowing a portion of the illuminating light to pass through the reflection plate prevents noticeable black streaks. On the other hand, if a negligible amount of light passes through the reflection plate, the device cannot effectively prevent the generation of black streaks. Conversely, if an excessive amount of light passes through the reflection plate, there will not be a sufficient cancellation of the charge present in the portion where the separation belt comes into contact with the edge of the photoreceptor surface. The latter image generating device depending upon the installation angle of the mirror-surface reflection plate, the cut-off angle of the edge and the pair of luminous bodies requires high-precision in the installation and cutoff operations. With less precision, the device cannot sufficiently prevent black streaks from being generated, and, it cannot thoroughly eliminate charge from the photoreceptor.

SUMMARY OF THE INVENTION

The primary object of the present invention is to reliably eliminate charge from the portion of the photoreceptor with which the separation belt comes into contact.

Another object of the present invention is to sufficiently prevent black streaks from being generated in the border between the charge-eliminated and charge-remaining portions of the photoreceptor.

A still further object of the present invention is to dispense with the requirement for providing extreme precision for the installation and the shape of the white-color reflection plate used for cancelling charge.

The image generating device according to the present invention first causes light reflected from an original document that is illuminated by a light source to be focused by lens means and then provides for generation of a static latent image by focusing the reflected light on the photoreceptor. The image generating device then develops the static latent image into a toner image, which is then transferred onto the copying paper, and finally, the toner-image received copying paper is peeled from the photoreceptor by the separation belt. The image generating device according to the invention is provided with a white-color reflection plate at a specific position of the component member supporting the light source unit. The white-color reflection plate eliminates charge from the edge portion of the photoreceptor with which the separation belt comes into contact. The white-color reflection plate is provided with a tapered tip end.

Desirably, the tapered tip end of the white reflection plate should have the cutout portion on the side of the light source unit.

When peeling the copied paper from the photoreceptor by means of the separation belt, the device causes charge to be eliminated from a specific portion of the photoreceptor with which the separation belt comes into contact by radiating light reflected from the white-color reflection plate onto the edge portion of the photoreceptor. The positioning of the white-color reflection plate at a predetermined position with respect to the component member supporting the light source unit effectively prevents a toner image from being generated on the belt-contacting portion of the photoreceptor and also prevents the separation belt from being soiled by toner, and yet, the system allows the copied paper to be reliably peeled from the photoreceptor. Since the original document illuminating position continuously varies, two states with and without occurrence of black streak, are sequentially generated, and as a whole, charge on the photoreceptor corresponding to the portion under these states almost disappears to eventually prevent generation of a noticeable black streak.

If the tip end of the white-color reflection plate is cut off on the side of the light source unit, light from the light source unit is also directed to the upper edge portion of the white-color reflection plate, thus allowing the system to more reliably prevent black streaks from being generated.

BRIEF DESCRIPTION OF THE DRAWINGS

The present invention will be better understood from the detailed description given hereinbelow and the accompanying drawings which are provided by way of illustration only, and thus are not limitative of the present invention. In the Drawings.

DESCRIPTION OF THE PREFERRED EMBODIMENTS

Figure 4:
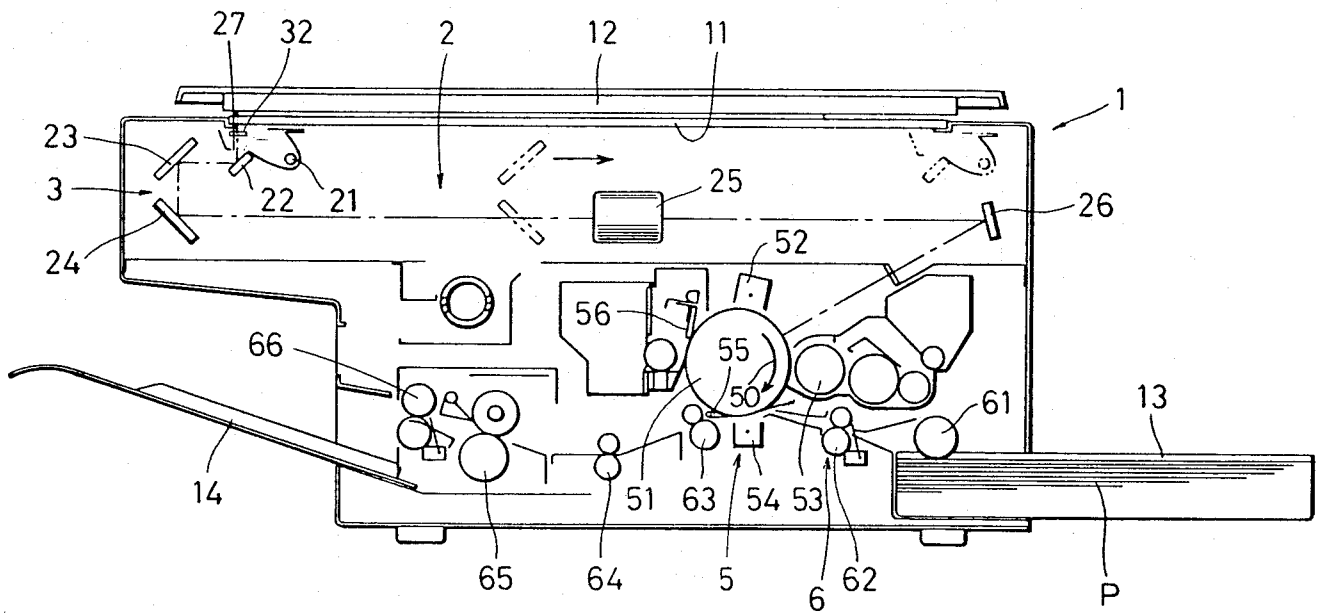
FIG. 4 is a schematic diagram showing the internal features of an electrophotographic copying machine incorporating the image generating device related to the present invention.

FIG. 4 is a schematic diagram denoting the internal constitution of an electrophotographic copying machine incorporating the image generating device according to the present invention. The copying machine body 1 is provided with a contact glass 11 and an original-cover 12 on the top surface, a detachable paper-feeding cassette 13 at a predetermined position on a lateral surface, and a paper-receiving tray 14 at a predetermined position on the opposite lateral surface. The copying machine body 1 incorporates an optical system 2, a copy treatment section 5, and a conveying section 6.

The optical system 2 is comprised of a light source 21 for illuminating the original document (not shown) placed on the contact glass 11, a slit 27 for controlling the width of a reflected light beam, mirrors 22, 23, and 24 for conducting light reflected from the original document, a lens 25, and another mirror 26. The optical system 2 moves the light source 21 and the mirror 22 at a specific speed and the mirrors 23 and 24 at one-half the speed of the light source 21 and the mirror 22 to sequentially expose the entire surface of the original document to light before formation of an image of the original document at the copy treatment section 5.

The light source 21 and the mirrors 22 through 24 are referred to generally as optical unit 3 hereinbelow.

Figure 2:
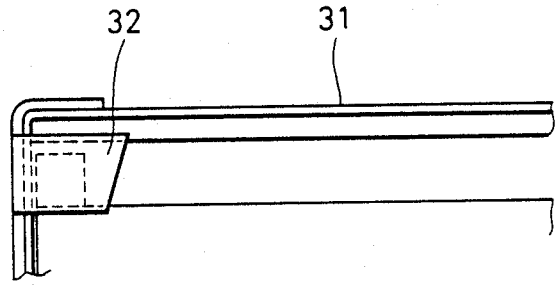
FIG. 2 is a plan view showing the essential parts of the optical system in accordance with the present invention.
Figure 3:
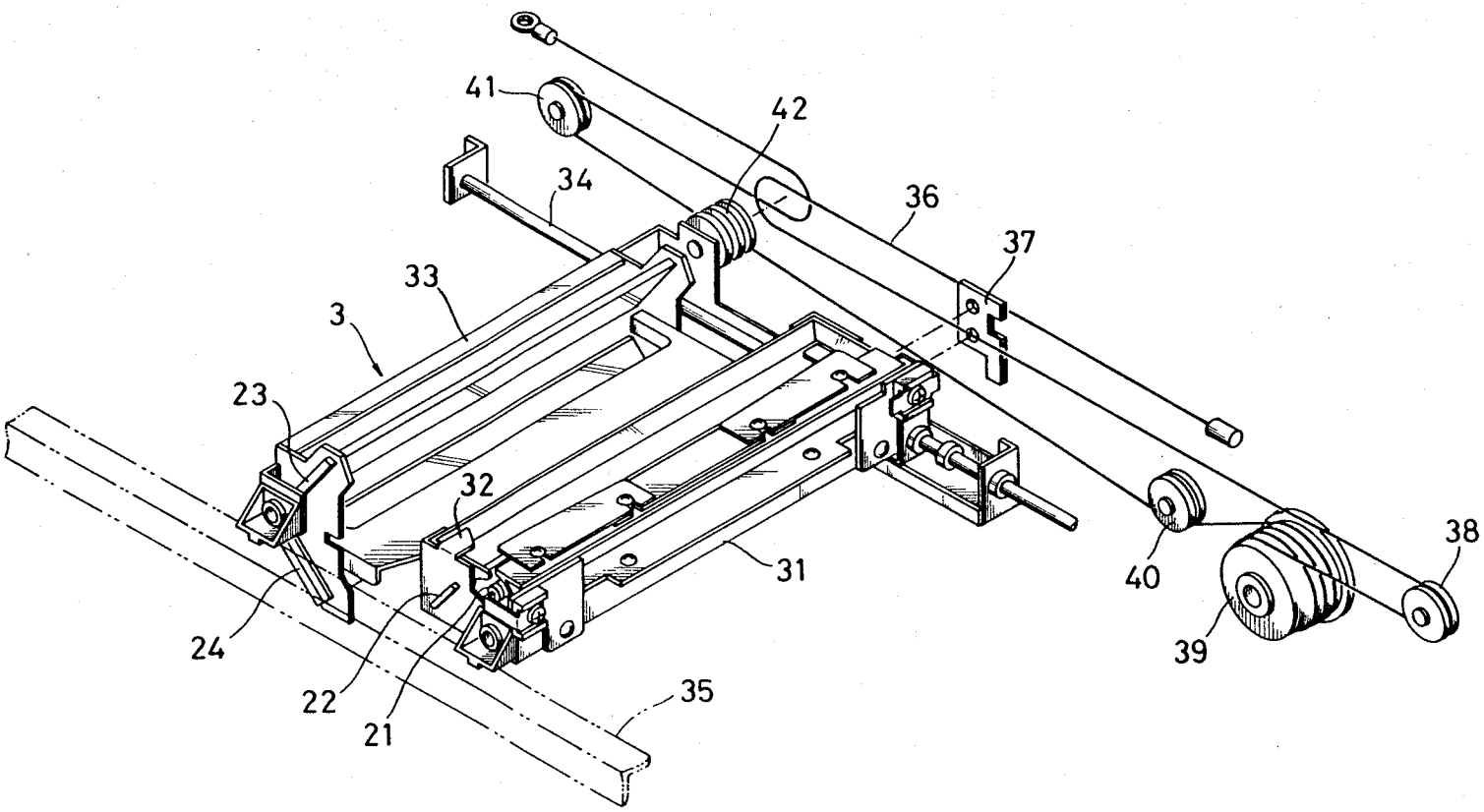
FIG. 3 is a perspective view showing the optical system in accordance with the present invention.

FIG. 3 is a detailed perspective view of the optical unit 3, while FIG. 2 is a plan view showing the essential parts of the optical unit 3. The light source 21 and the mirror 22 are installed at predetermined positions on a first frame member 31. A white-color reflection plate 32 extending in parallel with the light source 21 is integrally formed with the light source 21 at a predetermined position away from and above of the light source 21. The tip portion of the white-color reflection plate 32 adjacent the light source 21 is cut off so that a tapered shape is formed.

The mirrors 23 and 24 are respectively installed at predetermined positions on a second frame member 33. A guide shaft 34 supports the first and second frame members 31 and 33 so that these can slide as required.

A guide rail 35 is also provided to enable the frame members 31 and 33 to slide.

Both ends of a wire 36 for transmitting drive force to the optical unit 3 are secured at predetermined positions on the copying machine body 1. An end of wire 36 is wound over an interim roller 42 which is secured to the second frame member 33 and then the wire 36 is secured to a stationary plate 37 installed on the first frame member 31. The wire 36 is then wound onto a wire drum 39 via a guide pulley 38 and then wound onto a guide pulley 41 via a tension pulley 40 and an interim roller 42.

The copy treatment section 5 has a charger 52, a developer 53, a transfer charger 54, a separation belt 55, and a cleaner 56, respectively installed about the periphery of a photoreceptor drum 51 which is rotated in the direction indicated by the arrow 50 in FIG. 4. The static latent image generated on the surface of the photoreceptor drum 51 by light reflected from the original document is then developed into a toner image by the developer 53. The transfer charger 54 then transfers the toner image to a copying paper P, and then the toner-image-received copied paper is peeled from the photoreceptor drum 51 by the separation belt 55, and finally, the residual toner is collected from the surface of the photoreceptor drum 51 by the cleaner 56.

The conveying section 6 is comprised of a paper-feeding roller 61 feeding copying paper P from the paper-feeding cassette 13, a resist roller 62, conveying rollers 63 and 64, a thermo-fixation device 65, and a paper-discharging roller 66. The resist roller 62 conveys a copying paper P to contact the toner-transferring part of drum 51 synchronous with the static latent image, and then, the toner-image-received copied paper P is peeled from the photoreceptor drum 51 by the separation belt 55 and is conveyed by the conveyor rollers 63 and 64 to the thermal fixation device 65 for thermal fixation of the toner image. Finally, the paper-discharging roller 66 discharges the copy-completed paper P from the machine body 1 onto the paper-receiving tray 14.

Figure 1A:
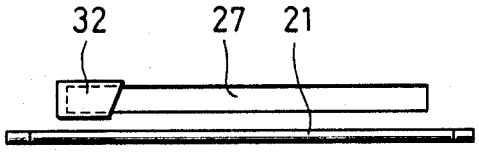
FIGS. 1(A), 1(B), and 1(C) are schematic diagrams of a bottom view, a side view, and an end view, respectively, of a copying machine image generating device in accordance with the present invention and are useful in explaining the charge cancelling operation at the edge of the photoreceptive drum.
Figure 1C:
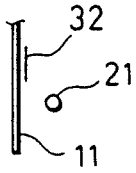
Figure 1B:
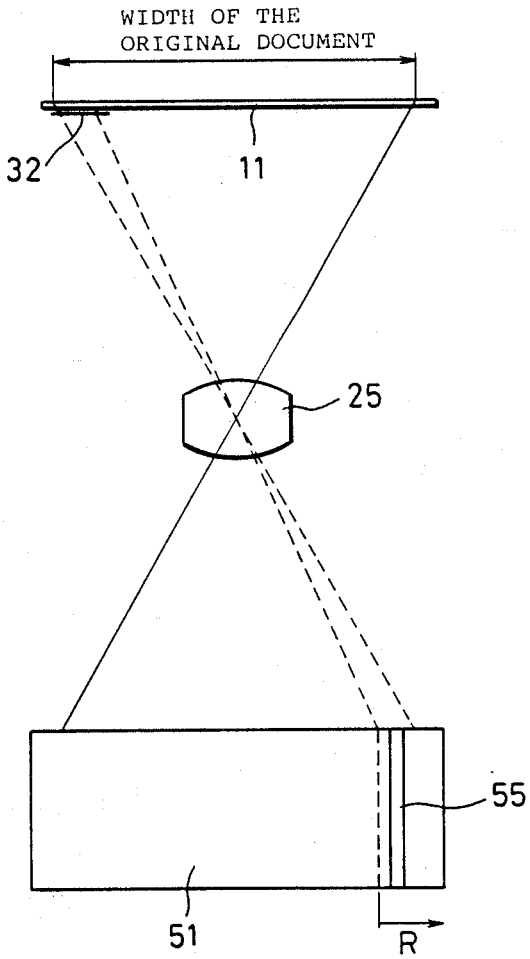

Referring now to FIG. 1, operation of the image-generating device of the present invention is described in detail below.

The copying machine incorporating the image-generating device of the present invention first moves the optical unit 3 at a specific speed by transmitting drive force from a drive system (not shown) to the wire drum 39 so that the entire surface of the original document is sequentially exposed to light. As the optical unit 3 moves, full-width area of the original document and the white-color reflection plate 32 are uniformly illuminated.

The light reflected from these is then focused by the lens 25 via the slit 27 and then, a static latent image corresponding to the image of the original document is generated by causing the image of the original document to be generated on the surface of the photoreceptor drum 51. More particularly, due to the light reflected from the white-color reflection plate 32, the charge at least in the portion R of drum 51 in contact with the separation belt 55 can be cancelled. The static latent image corresponding to black streaks and the original document image is generated by the light reflected from such portions which are right above the light reflected from the original document and the edges of the white-color reflection plates 32. Note that, although no reflected light is actually present in such portions just mentioned above, the above description intentionally uses the term reflected for convenience.

However, since the black-streak-generating portions are sequentially variable relative to the movement of the optical unit 3, as a whole, a static latent image close to white can be generated, and as a result, the image generating device according to the present invention prevents black streaks from being generated, thus and significantly improving quality of the reproduced image.

As is clear from the foregoing description, such portions of the photoreceptor drum 51 with which the separation belt 55 comes into contact generate a satisfactory static latent image close to white without requiring significantly improved precision in the installation position and the shape of the edge white-color reflection plate 32. This allows the image generating device of the present invention to prevent black streaks from being generated, and as a result, the quality of the reproduced image is significantly improved.

As shown in FIG. 51A, since in the preferred embodiment described above, the light source 21 obliquely radiates light to the position corresponding to the cutout portion of the white-color reflection plate 32, the area enabling generation of black streaks is minimized, thus the device according to the invention generates a satisfactory static latent image closer to white in those portions corresponding to edges of the white-color reflection plate 32.

It should be understood that the present invention is not limited to the preferred embodiment described above, but the present invention also allows the cutout portion of the white-color reflection plate 32 to be provided in a position remote from light source 21, and in addition, it also allows provision of cutout portions on both sides of the white-color reflection plate 32.

Furthermore, it is also possible in the image generating device related to the invention to modify designs of the device in various ways without departing from the essential spirit and scope of the invention defined in the following claims.

What is claimed is:

1. An image generating device for sequentially generating images in a copying machine having a substantially planar contact glass for holding an original document, said device comprising:

a light source;

means for moving said light source in a scanning direction for scanning an original document held on the contact glass with light from the source to scanningly illuminate the document;

a photoreceptor;

lens means for focusing on the photoreceptor light reflected from an original document illuminated by the light source to form on the photoreceptor a latent image of the content of the original document;

means for developing the latent image into a toner image;

means for transferring the toner image onto a copying paper to provide a toner-image-received copied paper;

separation means for separating the toner-image-received copied paper from the photoreceptor; and a substantially planar, reflection plate disposed on said moving means and lying in a first plane substantially parallel with a second plane defined by the contact glass for movement in the scanning direction to cancel charge present on portions of the photoreceptor coming into contact with the separation belt, the reflection plate terminating in an angular edge which has its angle entirely in said first plane and which is angled in the scanning direction from an inwardmost portion adjacent the reflection plate trailing edge in the scanning direction to an outwardmost portion adjacent the reflection plate leading edge in the scanning direction to define a tapered tip portion to occlude a varying portion of the original document and avoid formation of black streaks on the toner-image-received copied paper as the original document is scanned during copying.

* * * * *